United States Patent [19]

Eary, Sr.

[11] 4,346,488

[45] Aug. 31, 1982

[54] ADJUSTABLE UPPER BODY REST

[76] Inventor: George D. Eary, Sr., 8 N. Woodlawn Ave., La Vale, Md. 21502

[21] Appl. No.: 65,761

[22] Filed: Aug. 13, 1979

[51] Int. Cl.[3] ..... A47G 9/00

[52] U.S. Cl. ..... 5/436; 5/446

[58] Field of Search ..... 5/431, 434, 435, 436, 5/437, 440, 441, 446, 447; 269/328; 297/391

[56] References Cited

U.S. PATENT DOCUMENTS

| | | | |
|---|---|---|---|
| 2,509,086 | 5/1950 | Eaton | 5/440 |
| 2,958,373 | 6/1960 | Behrens | 5/440 |
| 3,828,377 | 8/1974 | Eary, Sr. | 5/435 |
| 3,913,155 | 10/1975 | Eary, Sr. | 5/435 |
| 3,946,452 | 3/1976 | Eary, Sr. | 5/435 |
| 4,028,754 | 6/1977 | Eary, Sr. | 5/428 |

*Primary Examiner*—Alexander Grosz

[57] ABSTRACT

An adjustable upper body rest is disclosed which is intended primarily for supporting the upper body while lying face down with the head turned to the right or left side to any degree up to approximately forty five degrees. A forehead rest consists of one or two members along with a lower face rest providing a variation of open areas for the eyes, nose and mouth, together with movable right and left shoulder support members permitting adjustment to differing body dimensions and allowing proper weight distribution, unrestricted breathing and body comfort while lying face down or on the right or left side. The upper body rest is prepared for lying on the right or left side very simply by turning the shoulder rests bottom up which provides a suitable higher elevation for the head as well as one arm.

6 Claims, 16 Drawing Figures

ADJUSTABLE UPPER BODY REST

BACKGROUND OF THE INVENTION

1. Field of the Invention

This invention relates to a support for the upper part of the body. More particularly it relates to a device which enables one to lie comfortably face-down with the head to the right or left side at any angle between thirty and sixty degrees, wherein the head and shoulders are cradled in a manner providing for a comfortable distribution of weight and which enables easy, unrestricted breathing through the mouth or nose. Moreover, it allows the user to lie on either the right side and shoulder or left side and shoulder comfortably by providing two elevated rests for the head, either of which sustains a large portion of body weight and all of the weight of the user's head, thereby relieving most normal pressure on the shoulder joint while lying on either side.

Many individuals have difficulty in sleeping or resting comfortably in a face-down or side position. This may be required during surgery, in post operation recovery or due to general afflictions such as arthritis. Either mode of repose, on either side or face-down is helpful to ladies who have had their hair coiffured and wish to preserve the results of their visit to the beauty parlor as long as possible. Likewise, sleeping face-down or on either side will avoid discomfort due to the presence of hair curlers. In addition, sunbathers will find this invention useful.

Also, those users who desire to sleep flat on their back a portion of the time will find that this device folds to an area smaller than the conventional pillow, which precludes the necessity of pushing it off of the bed to make room to stretch out flat. Alternately, for those who sleep on their back and wish to have a support under their head, there is provided a variety of elevations to rest their head upon while on-the-back repose is enjoyed.

2. Description of Prior Art

A number of devices have been patented which are stated to enable one to lie face-down or on the right or left side in comfort. While these devices do enable one to lie face-down or on the right or left side in a greater degree of comfort than they would have had in their absence, they are either not adjustable to take care of differing body dimensions or the desires of the user, or they do not properly support the head and shoulders in the best possible manner.

SUMMARY OF THE INVENTION

This invention consists of a base support having attached thereto a pair of spaced apart resilient shoulder supports which may be adjusted laterally and longitudinally relative to each other and also relative to the base support, allowing the distance between the base support and the shoulder supports to be varied. Fastened to the base and spaced longitudinally from the shoulder supports and equidistant therefrom is a resilient forehead support consisting of two separate rests, each adjustable and removeable, together forming a "V" and rotatable about a horizontal axis in a limited manner. In addition, a lower face rest is attached to the base, being resilient and prismatic in shape, located between the two shoulder rests and moveable from left to right. The lower face rest is rotatable about a horizontal axis in a limited manner, the axis being perpendicular to the forehead rest. The forehead rest can also be raised and lowered at either end separately or both ends simultaneously. Also, at each end of the forehead rest is a support for the shoulder rests when shoulder rests are positioned onto the upper body support.

DESCRIPTION OF PREFERRED EMBODIMENTS

Figure 1:
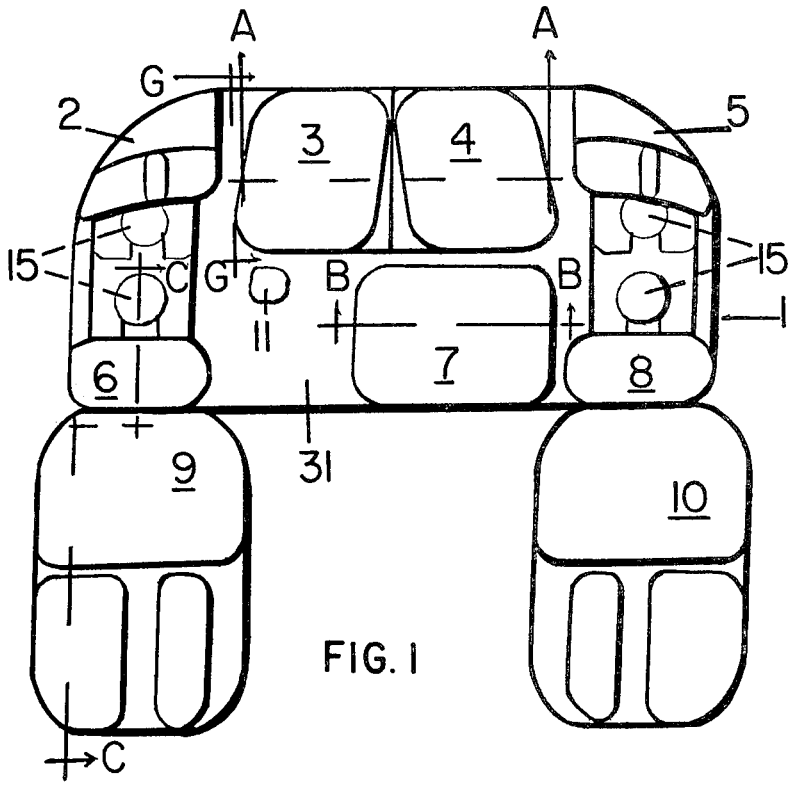
FIG. 1 is a plan view of the body rest as used for face-down repose.

FIG. 1 shows a head and shoulder rest designated generally as 1 which has a base 31. Base 31 is made of flat and relatively thin, semi-rigid material to serve as a support for the head and shoulder support members to be attached thereon and thereto. Preferable material for base support would be one of the various types of plastics. Alternately, aluminum, composition board, etc. could be used. Attached to base 31 at it's rearward portion are shoulder rest support members 6 and 8, which adjustably connect shoulder rests 9 and 10 to base 31 by use of two members identified 22 and shown in FIGS. 3 and 8. Attaching member 22 may be made of a flexible material such as leather, plastic, elastic, etc. and fastened at the ends with snaps, buttons, hook and loop type fasteners, such as the ones sold under the trademark Velcro, etc. Near the center of base 31 are mounted resilient face rests 3, 4 and 7, and fastened to their undersides are bases 16, 17 and 19 respectively, which may be made of the same material as base 31. Members 2 and 5 are support members for shoulder rests 9 and 10 when said shoulder rests are positioned bottom-up to provide a higher elevation head rest when the user desires to lay on the right or left side.

Figure 2:
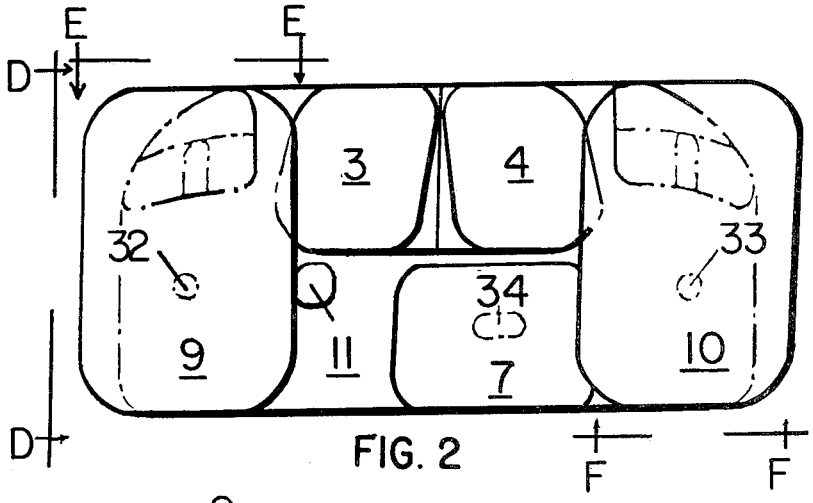
FIG. 2 is a plan view of the body rest as used for repose on the right or left side.

FIG. 2 is a plan view of the upper body rest showing the correct relative positions of all members as prepared when the user desires to lay on the right or left side. Openings 32, 33 and 34 are provided in the resilient material for better hearing capabilities of a small radio which may alternately be adapted to fit within the plastic forms of 9, 10 or 7. Member 11 shown in FIGS. 1 and 2 is a stop for lower face rest 7. Two such stops are provided, the right one omitted for clarity, to determine location of lower face rest 7 when it is moved from right to left or left to right. Member 11 is adjustable by rotating it about a vertical axis, thereby providing a variety of positions at which member 7 may be located and thus provides a means of aligning member 7 with members 3 and 4.

Figure 3:
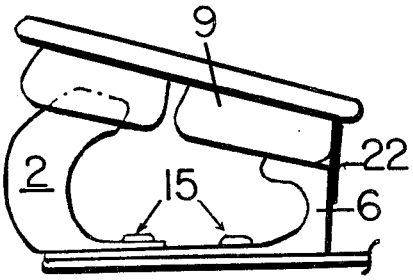
FIG. 3 is an elevation view along line D—D of FIG. 2.

FIG. 3 is an elevation view of rest 9 as it is supported by members 6 and 2, showing member 9 here as a head rest and angled downward from front to rear. Also shown is member 22 which hinges member 9 to member 6. Although member 22 is shown here as cloth, leather, elastic or plastic, this function could also be provided by use of a hinge pin.

Figure 4:
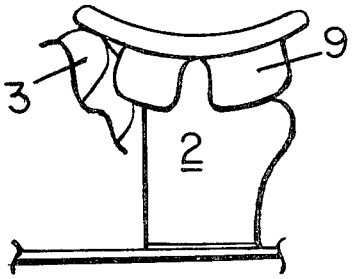
FIG. 4 is an elevation view along line E—E of FIG. 2.

FIG. 4 is an elevation view of rest 9 being supported by support member 2 and forehead rest 3. Note protrusion at the top of support 2 into cavity of rest 9 which is provided to stabilize and prevent side slippage of rest 9.

Figure 5:
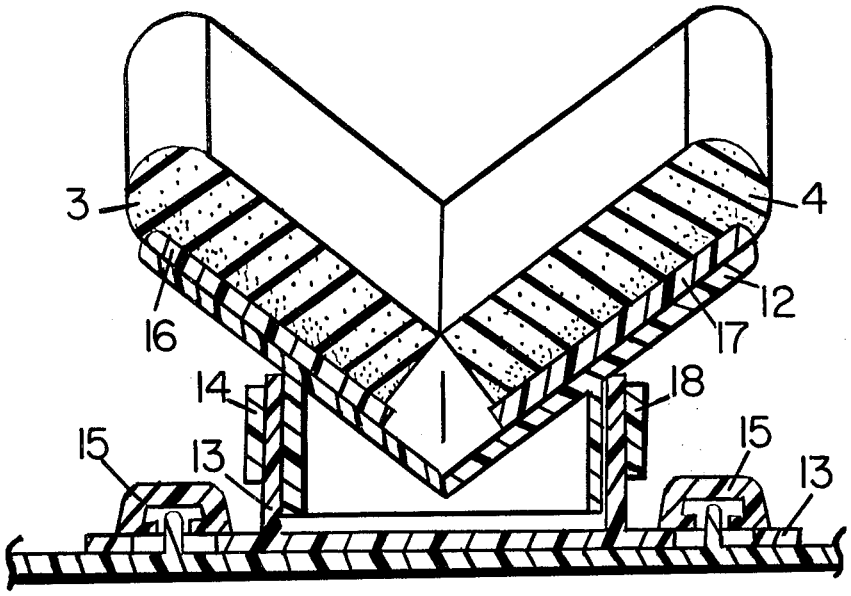
FIG. 5 is a sectional view along line A—A of FIG. 1.
Figure 9:
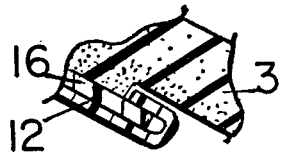
FIG. 9 is a sectional view along line K—K of FIG. 10.
Figure 10:
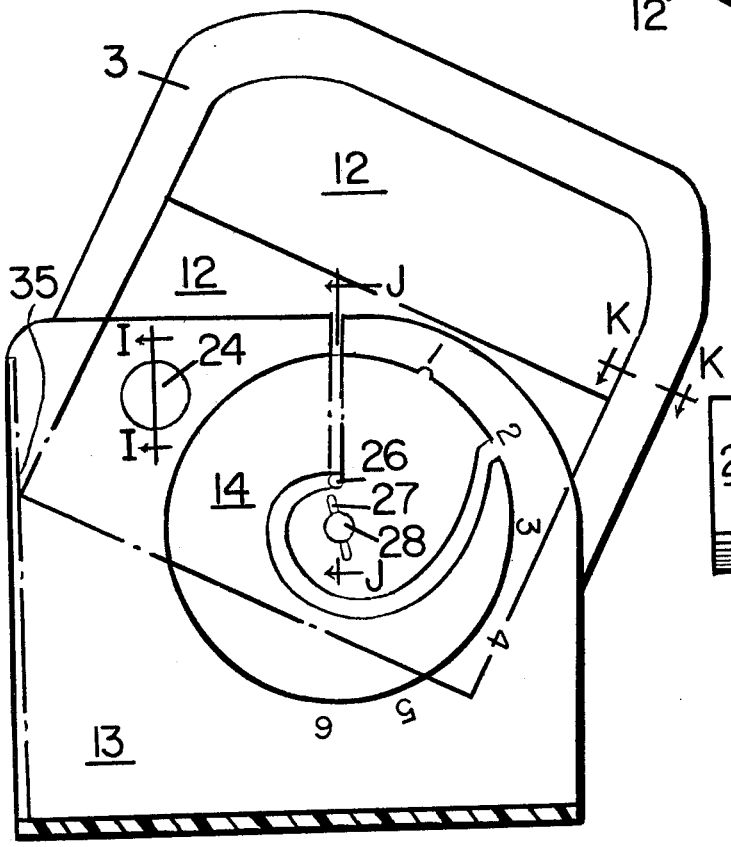
FIG. 10 is a sectional view along line G—G of FIG. 1
Figure 11:
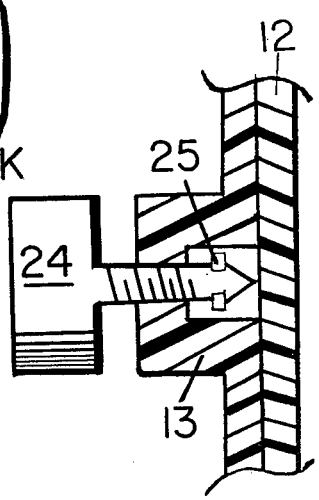
FIG. 11 is a sectional view along line I—I of FIG. 10.
Figure 12:
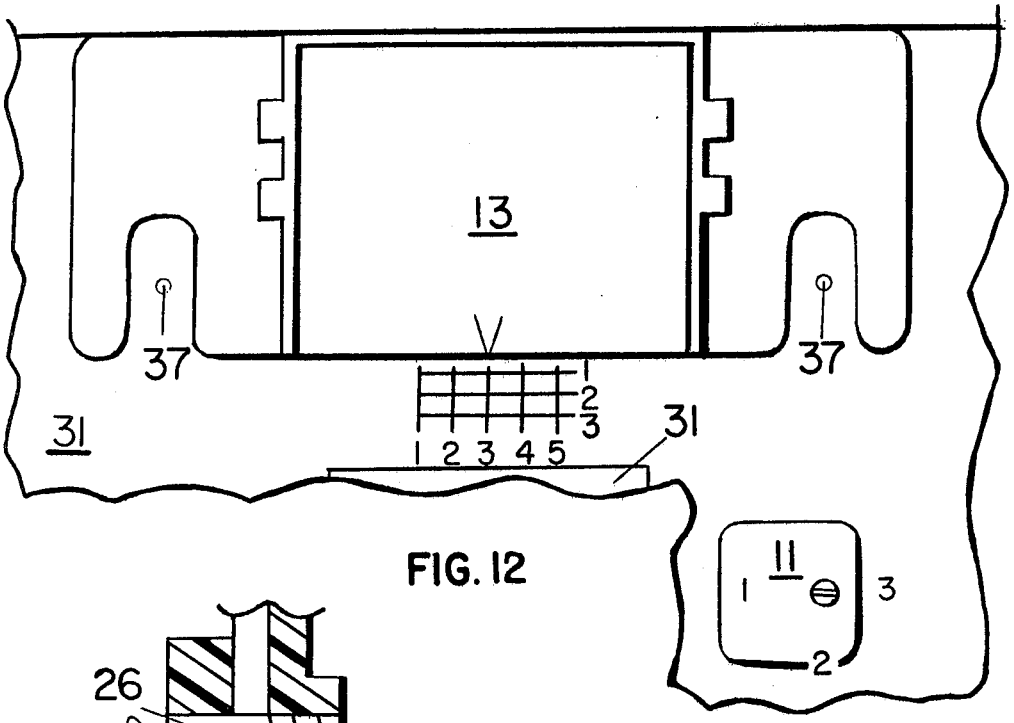
FIG. 12 is a plan view of the forehead support with the forehead rests omitted for clarity.
Figure 13:
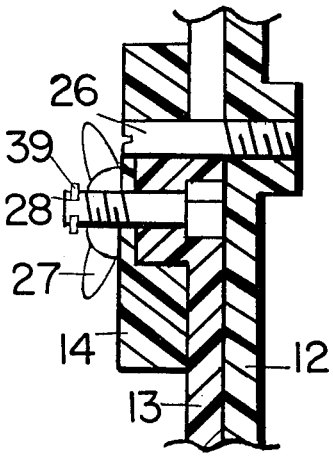
FIG. 13 is a sectional view along line J—J of FIG. 10.

FIG. 5 considered in conjunction with FIGS. 9, 10, 11, 12 and 13 shows the adjustability of forehead rests 3 and 4. Support member 13 consists of a notched horizontal base adjustably attached to base 31 by a knob 15 on the left end and a similar one at the right end, and when loosened, allows lateral and longitudinal movement of support member 13 in a limited manner or complete removal of said support 13 from base member 31. Moreover, a portion of member 13 is vertical and forms an inverted "U" shape shown clearly in FIG. 12. The base portion of member 12 nests within said vertical inverted "U" shaped portion of member 13. Referring now to FIGS. 5, 10 and 13 it becomes apparent that support member 13 controls the elevation of member 12 by pin 26 which is threaded into member 12. Likewise, as knob 14 is rotated clockwise, carrier member 12 is moved upward at the left end. Knob 18 at the right end is similar and controls elevation movement of the right end of carrier member 12. The base of carrier member 12 is shown as being slightly shorter in length from left to right than is the mating vertical portion of support member 13, allowing slight longitudinal movement of member 12. The aforementioned variance of dimensions, shown at the right hand end near knob 18 in FIG. 5, allows limited elevation movement of member 12 at one end only while the opposite end remains stationary. In addition, the variance of dimensions allows easy installation of member 12 into the slots of members 13, 14 and 18. The elevation of both ends of member 12 is normally changed simultaneously in the same direction, and is done in an unobstructed manner. Now considering FIGS. 5, 9 and 10 it is revealed that bases 16 and 17 of forehead rests 3 and 4 respectively nest snugly within a curved portion of member 12 providing a means to stabilize rests 3 and 4 closer together, farther apart or to remove one or both from carrier member 12 completely.

To reveal the rotateability of forehead rests 3 and 4, refer again to FIGS. 5, 10, 11 and 13. It becomes apparent that carrier member 12 will rotate about a horizontal axis around a pin 26 at each end, but in a manner limitted by base of carrier member 12 coming into contact with support 13 as indicated by number 35 in FIG. 10. After the use has rotated rests 3 and 4 to a comfortable position, member 12 can be stabilized by tightening knob 24, shown in FIGS. 10 and 11.

Figure 6:
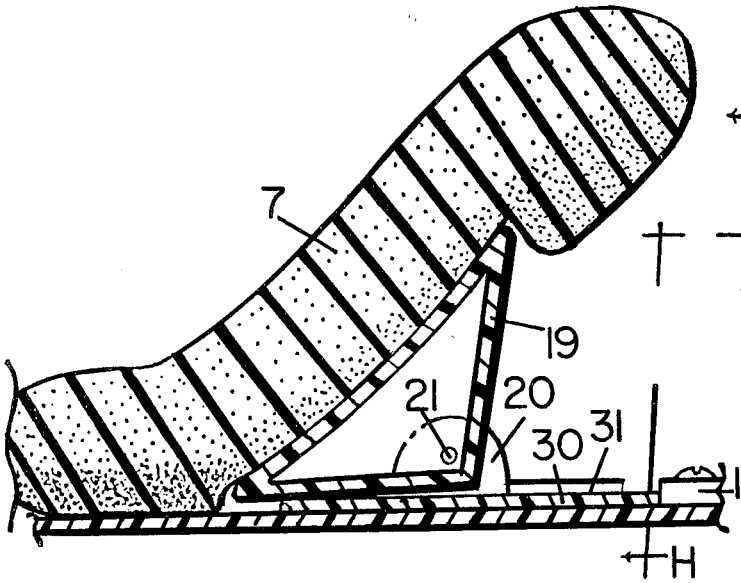
FIG. 6 is a sectional view along line B—B of FIG. 1.
Figure 7:
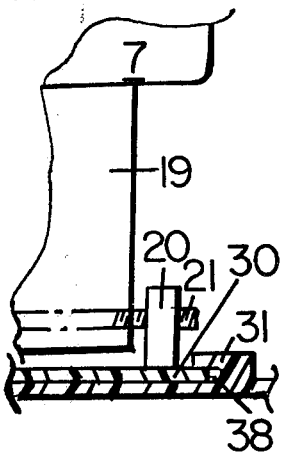
FIG. 7 is a sectional view along line H—H of FIG. 6.

FIG. 6 is a sectional view of the lower face rest 7 shown located to the right side against locator member 11, which is the proper location of rest 7 when the user desires his head to be turned at an angle to the left. Upon examination of FIGS. 6 and 7 together, the limited rotateability of rest 7 about a horizontal axis becomes obvious. Threaded pin 21 secures plastic form 19 to base 30 by passing through form 19 and a hub 20 at each end of form 19 and the two hubs identified as 20 are both inseparable parts of base 30. Likewise, face rest base 30 is secured to pillow base 31 by a notched overlay at two sides, one of which is shown in FIG. 7 and both overlays are inseparable parts of base 31. The unique design of rest 7 is revealed in FIG. 6 and further defined as a member that configures to the user's lower face whether positioned to the right or left. Note the bottom left area being horizontal whereon the user's cheek-bone nests. The center of the rest is always slightly concave and the very top right remains slightly convex and without direct support. When rest 7 is moved to the left to allow the user to position the head at an angle to the right, the convex top now becoms the horizontal bottom at the right and the horizontal bottom becomes a convex top at the left with the rest sloping upward to the left. The over-hang of resilient material at each end is shown to be considerably thicker than the central concave area and the extra thickness is made of the dense foam. Also shown in FIG. 7 at number 38 is a distance between base 30 and overlay 31 which allows a limited rotational movement of base 30 and rest 7 about a vertical axis, whether located to the left or to the right. Likewise, form 19 and rest 7 may be completely removed from base 31 by first removing threaded pin 21.

Figure 8:
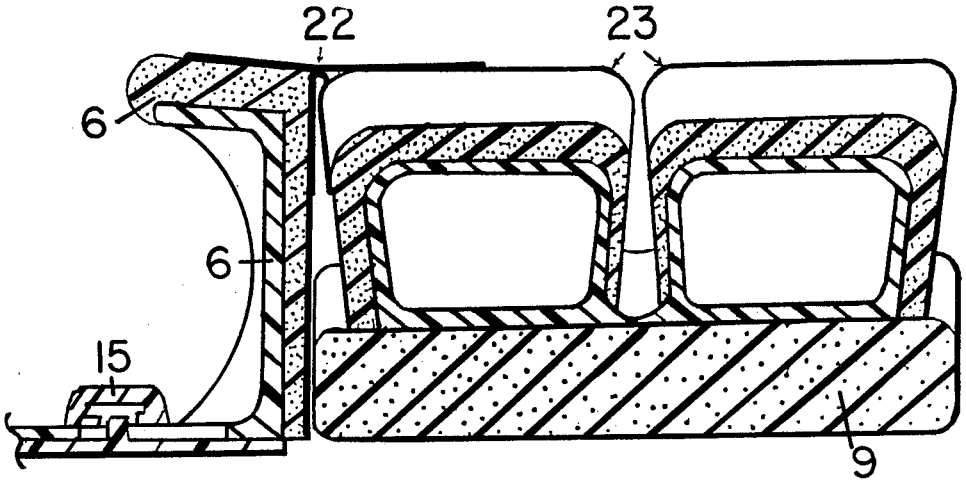
FIG. 8 is a sectional view along line C—C of FIG. 1.

FIG. 8 is a sectional view showing shoulder rest 9 and attachment to support member 6 by use of member 22 which has four ends and the two pieces are attached near the middle. The upward portion of members 9 and 6 are the surfaces contacted by the shoulders when laying face-down and consists of semi-rigid plastic forms covered by a relatively thin layer of dense polyurethane foam, all of which is covered by a thin plastic 23 which is similar to that used to cover the muffs on ear protectors that are used while target practicing. The same type dense foams and thin plastic also covers members 2, 5, 8 and 10, at least on their outward and upward surfaces. In addition, all rest surfaces of members 3, 4, 6, 7, 8, 9 and 10 that contact the user's face or shoulders may have a final or top cover made of cloth, etc. The bottoms of shoulder rests 9 and 10 consists of light foam or the like.

FIG. 9 shows a curved portion of member 12 at the lower or rearward side. A similar curved parallel portion is also provided at the higher or forward side of member 12 to snugly nest base 16 of rest 3. Also, similar curved and parallel portions of member 12 are provided for the snug nesting of base 17 of rest 4.

FIG. 10 shows means provided to allow quick readjustment of the elevation of rests 3 and 4 at a later time and to a previously determined comfortable position by turning an index of knobs 14 and 18 to a memorized point indicated by numbers provided on member 13 around the peripheries of knobs 14 and 18. Knobs 14 and 18 are similar in all respects except for the cavity provided for the nesting of the hub protruding from member 13. Referring to FIG. 13, said cavity in knob 14 starts at the right side and extends toward the left side. The similar cavity in knob 18 starts at the left side and extends toward the right side, though not shown. This design dictates that the index pointer at reference number 1 of both knobs would be turned downward to elevate rests 3 and 4 simultaneously. The inside surfaces of the curved slots in knobs 14 and 18 are the bearing surfaces and cams or presses pins 26 of member 12 upward. The outside surfaces of said curved slots prevents any accidental or unwanted upward movement of member 12.

FIG. 11 is a sectional view showing stabilizing screw 24 secured by snap ring 25 to prevent complete disengagement of member 24 from support member 13. A left hand threaded screw 24 is provided at one end, not shown, and a right hand threaded screw at the other end of member 13, is provided. Opposite hand threaded stabilizer screws provide the capability of tightening or loosening of said screws with the user's right and left hands moving in the same rotational direction, to stabilize carrier member 12 after a comfortable elevation and angular position has been established by the user.

FIG. 12 is a cutaway or partial plan view of base member 31 and support member 13. Shown at the center on the rearward side of member 13 is an index pointer "V". On base 31 near said index pointer "V" is a grid pattern that provides a means to correlate the position of member 13 with base 31. Also shown at the lower right is an adjustable locator member 11 completely covering reference number 1. When locator 11 is in this position, rest 7 will be located to the right and nearest the center of base 31. When locator 11 is rotated 90 degrees counter-clockwise to completely cover reference number 2, rest 7 will be located about one quarter of an inch nearer the right end of base 31. When locator 11 is rotated an additional 90 degrees counter-clockwise to completely cover reference number three, rest 7 will locate at the farthest possible position toward the right end of base 31. A locator 11 is also provided at a similar position on the left side of base 31 and both are fastened to base 31 in a snug manner so as not to rotate unless effected by the user.

FIG. 13 is a sectional view showing means provided to change the elevation of carrier member 12 and thereby forehead rests 3 and 4. Means of securing knob 14 to support member 13 is shown to be wing-nut 27 and threaded member 28. When desired elevation of carrier member 12 is obtained, tightening of wing nut 27 assures said elevation will be maintained. Snap or "O" ring is provided at the end of member 28 to prevent disengagement of wing-nut 27 from threaded member 28 and is shown to be member 39. A similar means is provided for knob 18 at the right end.

Figure 14:
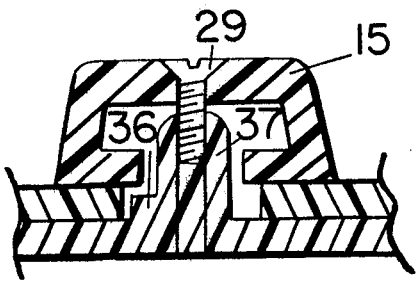
FIG. 14 is an enlarged sectional view showing means of attachment of supports 2, 5, 6, 8 and 13.

FIG. 14 is an enlarged sectional view showing the application of knob 15 as a securing means of the various members. Threaded member 29 threads into protruding portion of members 6, 8 and 31 shown at number 37 in FIGS. 14 and 12. Where used to secure support member 13 two places, both sides of protrusion 37 is as shown in FIG. 14 on the right side without shoulder shown at number 36. Where used to secure members 2, 5, 6 and 8, a shoulder shown at number 36 is added at right and left sides of protrusion 37 and is slightly thinner than secured members 2, 5, 6 and 8. The widths and lengths of said shoulders to be approximately $\frac{3}{4}''$ wide by $1\frac{1}{2}''$ long so as to allow limited rotational, longitudinal and lateral movement of secured members 2, 5, 6 and 8. Threaded member 29 is designed to be a length which will contribute to safety. If any knob 15 should become completely disengaged, the recessed extremety of member 29 precludes any possiblity of injury to the user.

Figure 15:
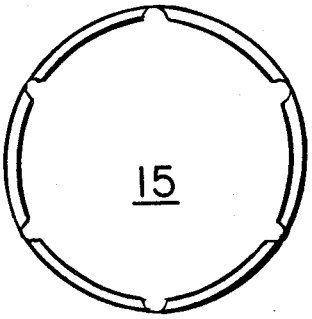
FIG. 15 is an enlarged plan view of the knob provided to secure supports 2, 5, 6, 8 and 13 in a desired location.

FIG. 15 is an enlarged plan view of knob 15 showing protrusions around the periphery to provide user with added tightening capabilities of knob 15. Also, a like capability can be provided by adding six or such number of sides at the periphery of knob 15.

Figure 16:
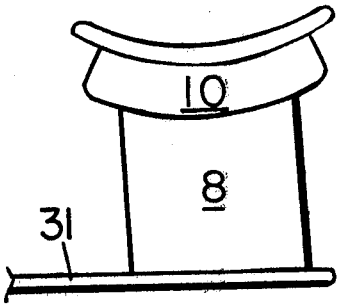
FIG. 16 is an elevation view of the right shoulder rest 10 as it is positioned on support 8 which is shown tilted slightly to the left or center of the body rest.

FIG. 16 is an elevation view of the shoulder rest 10 sustained by support member 8 which is designed to lean slightly toward the center of the upper body rest and with the outside edge of rest 10 slightly higher than the inside of rest 10. This configuration is provided to compensate for a less amount of support by base 31 beyond the right side of support member 8. Left support member 6 is configured in a similar manner.

What is claimed:

1. An adjustable rest for the head and shoulder portion of the human body in a predetermined position and comprising:

a. a base member, b. a pair of laterally spaced apart resilient shoulder support members adapted to support the shoulders of said human body in a predetermined position, c. each of said shoulder members being so attached to allow limited lateral and longitudinal movement relative to the base and allow complete removeability from the said base, d. each of said shoulder members being so attached to allow limited rotational movement around a vertical axis, and to allow limited rotational movement around a horizontal axis, whereby said shoulder support members can be positioned on support members to provide a higher elevation head rest, e. means to secure each of said shoulder members to the base in an immovable manner at any one of many desired positions, f. a forehead support member having separate interconnected movable members comprising at least one element supporting the forehead, configured as a "V" tilted towards the user's face when the user is in a face down position, and providing support for the human forehead at varying degrees between the vertical and horizontal positions to the right or left side, g. said forehead support member being movable laterally and longitudinally in a limited manner relative to the base and to a lower face rest, providing means to vary the distance between and to align the lower face member with the forehead support member, h. said forehead support member being rotatable in a limited manner about vertical and horizontal axes, i. means provided to secure said forehead rest in the desired lateral, longitudinal and rotational position in an immovable manner as well as to allow complete removability from the base, j. means provided to adjust the elevation of the forehead supporting member at either end only or at both ends simultaneously, k. a lower face rest, rotatable about a horizontal axis, perpendicular to said forehead supporting member in a limited manner, providing a slightly concave central support area at an approximately forty-five degree angle relative to the base member, rising upward to the right when user's head is to the left and rising upward to the left when the user's head is to the right, l. said lower face rest having its extremities unsupported, thereby allowing means to configure to the user's lower face when the face is turned to the right or the left, m. lower face rest stops, one at the right and one at the left providing a variety of locations for the lower face rest to the right or left allowing additional alignment capabilities to the forehead support member, n. a correlation capability of the position of at least one movable member as related to a mating member being provided by an index point on one member and reference numbers on the mating member, o. a higher elevation suitable for the support of the user's head and arm while lying on the right or left side being provided by the softer bottoms of two hinged shoulder members which are turned bottom-up, p. a support so designed to prevent side slippage or tilt of the shoulder member being provided at each end of each shoulder member for use while located in the bottom-up position with the shoulder member running downward toward the user's body.

2. The device of claim 1, wherein at least one of the resilient support members has an elastic inflatable bladder core being adapted to be filled to various sizes thereof with fluids.

3. The device of claim 2 wherein said core is provided with a suitable cover of polyurethane and cloth.

4. The device of claim 1 wherein exposed structural surfaces are covered with a resilient material such as polyurethane to protect the user from injury.

5. The device of claim 4 wherein said polyurethane is covered with thin plastic.

6. The device of claim 1 wherein at least one supporting surface normally in contact with user's body is covered with cloth.

* * * * *